US009526275B2

(12) United States Patent
Geymayr

(10) Patent No.: US 9,526,275 B2
(45) Date of Patent: Dec. 27, 2016

(54) ADJUSTABLE PREGNANCY AND POSTPARTUM SUPPORT WRAP WITH AUDIO OUTPUT

(71) Applicant: Debra Geymayr, Miami, FL (US)

(72) Inventor: Debra Geymayr, Miami, FL (US)

( * ) Notice: Subject to any disclaimer, the term of this patent is extended or adjusted under 35 U.S.C. 154(b) by 0 days.

(21) Appl. No.: 14/679,974

(22) Filed: Apr. 6, 2015

(65) Prior Publication Data

US 2015/0282532 A1 Oct. 8, 2015

Related U.S. Application Data

(60) Provisional application No. 61/975,038, filed on Apr. 4, 2014.

(51) Int. Cl.

| | |
|---|---|
| ***A41C 1/10*** | (2006.01) |
| ***H04R 1/02*** | (2006.01) |
| ***A41D 27/20*** | (2006.01) |
| ***H04R 5/02*** | (2006.01) |

(52) U.S. Cl.

CPC ..... *A41C 1/10* (2013.01); *A41D 27/205* (2013.01); *H04R 1/028* (2013.01); *H04R 5/023* (2013.01); *H04R 2201/023* (2013.01)

(58) Field of Classification Search

CPC ..... A41D 1/005; A41D 27/205; H04R 1/02; H04R 5/23

USPC ..... 600/591, 551, 587, 475, 595, 310, 453; 381/24, 90, 67, 187, 77, 188, 205, 58; 450/155; 2/338, 310–312

See application file for complete search history.

(56) References Cited

U.S. PATENT DOCUMENTS

| | | | | | |
|---|---|---|---|---|---|
| 5,109,421 | A * | 4/1992 | Fox | H04R 1/02 | 2/338 |
| 5,699,558 | A * | 12/1997 | Min | H04R 5/023 | 2/338 |
| 5,764,776 | A * | 6/1998 | Francais | H04R 5/023 | 381/300 |
| 5,913,834 | A * | 6/1999 | Francais | H04R 5/023 | 600/591 |
| 6,097,822 | A * | 8/2000 | Min | H04R 5/023 | 2/102 |
| 8,847,754 | B2 * | 9/2014 | Buchheim | G01S 1/68 | 340/539.13 |
| 2002/0196959 | A1 * | 12/2002 | Gurner | H04R 5/023 | 381/333 |
| 2008/0029333 | A1 * | 2/2008 | Oz | A41D 1/005 | 181/126 |
| 2014/0135042 | A1 * | 5/2014 | Buchheim | G01S 1/68 | 455/456.6 |

* cited by examiner

*Primary Examiner* — Gloria Hale

(74) *Attorney, Agent, or Firm* — Dunlap Bennett & Ludwig PLLC

(57) ABSTRACT

An elongated garment to support a pregnant mother and her unborn baby in utero is provided. The elongated garment may be dimensioned and adapted to lift the abdominal area of the pregnant wearer, support the hip area of the pregnant woman, reduce pelvic floor pressure and low back strain. The elongated garment is also adapted to provide a plurality of safe-decibel audio output which may be used with any media device, with pockets specifically positioned inside the garment used on the abdominal area so as to help guide her unborn baby into a head-down orientation in preparation of birth.

2 Claims, 4 Drawing Sheets

ADJUSTABLE PREGNANCY AND POSTPARTUM SUPPORT WRAP WITH AUDIO OUTPUT

CROSS-REFERENCE TO RELATED APPLICATION

This application claims the benefit of priority of U.S. provisional application No. 61/975,038, filed 4 Apr. 2014, the contents of which are herein incorporated by reference.

BACKGROUND OF THE INVENTION

The present invention relates to pregnancy wraps and, more particularly, to an adjustable pregnancy wrap providing safe-decibel audio output for prenatal and postpartum use.

During pregnancy, the well being of the unborn baby and the mother can be compromised. For example, as pregnancy progresses the increasing abdominal weight of the mother frequently causes pelvic floor pressure and lower back strain. Additionally, in the later stages of the pregnancy, the positioning of the unborn baby in other than a "head-down" orientation can be problematic during delivery.

Also during pregnancy, the well being of the unborn baby and the mother can be supported. For example, there are garments that support the added weight of the mother's abdomen. Additionally, research has shown that music played to the unborn baby during pregnancy can be recalled by the newborn baby and will also result in a calmer infant.

However, current pregnancy garments either transfer the added weight to the shoulders, which results in upper back strain, poor posture, or are belts that are uncomfortable to wear and cannot be used after birth "postpartum." Current pregnancy garments have audio output which does not use safe-decibel speakers. Current pregnancy garments do not have pockets that are specifically placed in the belt in order to help guide baby head down for birth. Current pregnancy garments trap heat along the abdominal area of the expectant mother, making it hot and uncomfortable to wear. Moreover, when speakers are incorporated with such pregnancy garments, they are haphazardly positioned in no particular pattern, and speakers cannot be used postpartum.

As can be seen, there is a need for a soft, slim-fitting wrap providing safe-decibel audio output with correctly positioned speakers to help guide the head of the unborn baby into a downward orientation while providing abdominal and pelvic floor support, relieving low back strain, and helping with the overall maternal posture during pregnancy.

For postpartum use, the wrap may be used to help support mother's hips and abdominal muscles to assist with postpartum recovery. There is a unique ability to peel adhesive backing of the safe-decibel speakers, placing either on a stroller or crib of the infant to replay music used prenatally. This recall of music has been proven to calm babies.

SUMMARY OF THE INVENTION

In one aspect of the present invention, a slim fitting, adjustable pregnancy support wrap configured to provide safe-decibel audio output includes an elongated soft material having an exterior surface and an interior surface, both surfaces extending from a first end to an opposing second end, wherein the elongated soft material is dimensioned so as to circumscribe an abdominal area and hips of a pregnant human wearer; a plurality of pockets formed by the soft material along both the exterior surface and the interior surface; and an adjustable velcro fastener disposed near the first and second end.

In another aspect of the present invention, a slim fitting, adjustable pregnancy support wrap configured to provide safe-decibel audio output includes an elongated soft material having an exterior surface and an interior surface, both surfaces extending from a first end to an opposing second end, wherein the elongated soft material is dimensioned so as to circumscribe an abdominal area and hips of a pregnant human wearer; a plurality of pockets formed by the soft material along both the exterior surface and the interior surface; an adjustable velcro fastener disposed near the first and second end; at least one speaker disposed within at least one of the pockets, wherein each speaker is adapted to project a plurality audio output, has a thin profile, and provides safe-decibel volume functionality; and an adhesive backing disposed along a portion of each speaker for postpartum use.

In yet another aspect of the present invention, a method of utilizing the slim fitting, adjustable pregnancy support wrap with the safe-decibel speakers is to help guide the head of an unborn baby into a downward orientation while relieving the additional weight imposed on the expectant mother in her hips and abdominal area, includes the steps of providing the slim fitting, adjustable pregnancy support wrap; supporting the abdominal area of the wearer, reducing pelvic floor pressure, reducing low back strain while securing the pregnancy support wrap to its suitably adjusted length by fastening the adjustable velcro fastener of the first and second end; positioning each speaker so as to project the plurality of safe-decibel audio output upwardly from near the wearer's cervix and toward the unborn baby. Postpartum use of both the wrap and adhesive back speakers is a unique feature advantage.

These and other features, aspects and advantages of the present invention will become better understood referencing the following drawings, description and claims.

DETAILED DESCRIPTION OF THE INVENTION

Figure 1:
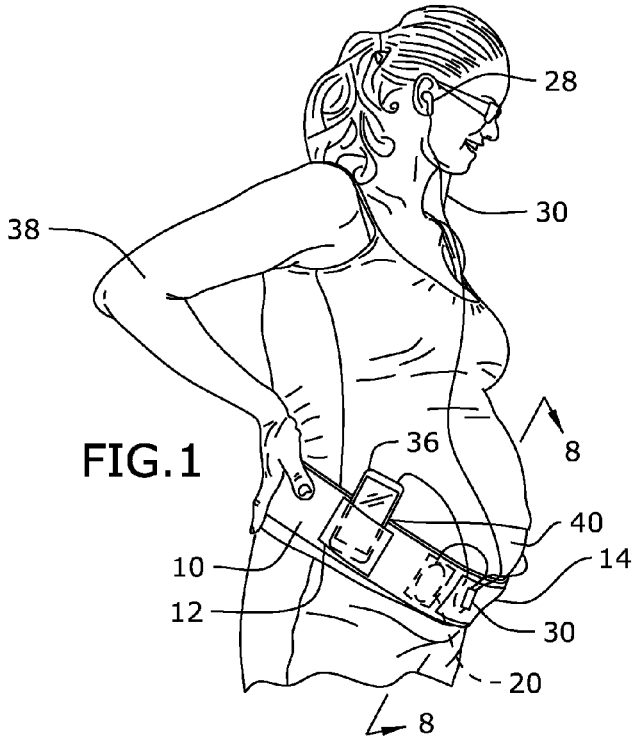
FIG. 1 is a perspective view of an exemplary embodiment of the present invention, shown in use.
Figure 2:
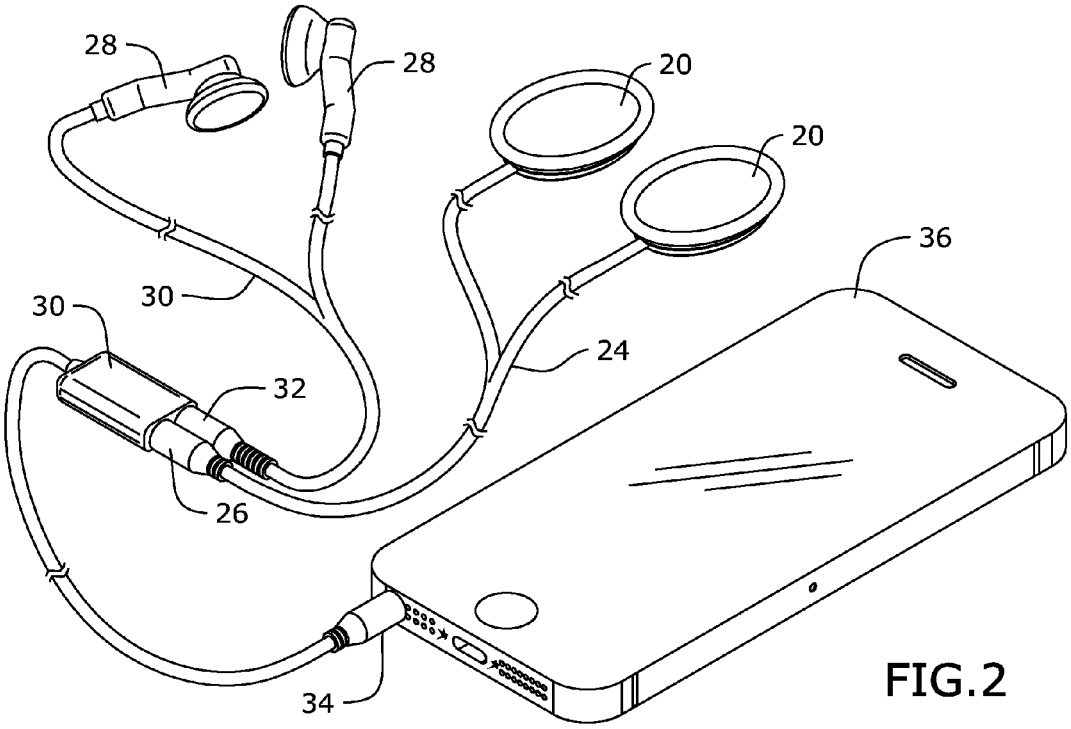
FIG. 2 is a perspective view of an exemplary embodiment of a portable audio player of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an elongated garment to support a pregnant mother and her unborn baby. The elongated garment may be dimensioned and adapted to lift the abdominal area of the pregnant wearer. The elongated garment is also adapted to provide a plurality of safe-decibel audio output that is specifically positioned along said abdominal area so as to help guide her unborn baby into a head-down orientation in preparation of birth.

Referring to FIGS. 1 through 11, the present invention may include an elongated garment 10 and an audio device 36.

The audio device 36 may be adapted to produce a plurality of audio output through a plurality of safe-decibel speakers 20 and a plurality of headphones 28. In certain embodiments the audio device 36 may be interconnected to the plurality of speakers 20 and the plurality of headphones 28 by a plurality of audio components, including but not limited to speaker wires 24, a speaker jack 26, headphone wires 30, a headphone jack 32, a splitter/adaptor 31, a splitter/adaptor 33 and a splitter/adaptor jack 34, as illustrated FIG. 2. In an alternative embodiment, the audio device 36 may be remotely connected to the plurality of speakers 20 and the plurality of headphones 28. The plurality of audio output may include different media devices and forms of music, tones, pulses, sounds, combinations thereof and the like, which may be adapted to attract an unborn baby 42, calm an infant, and the like.

Each speaker 20 may have a thin profile and provide an adhesive backing 22 adapted to removably attach to a supporting surface 46 of a structure 44, such as a crib, stroller or the like. The adhesive backing 22 may include peel-away and stick functionality. Each speaker 20 may include safe-decibel volume functionality.

The elongated garment 10 may be dimensioned and adapted to provide lift and support to an abdominal area 40 of a wearer 38. The elongated garment 10 may be made of lightweight, soft material having an exterior surface and an opposing interior surface, both extending from a first end to an opposing second end. Each end may provide complementary portions of an adjustable fastener 18. The adjustable fastener 18 may be any fastener known in the art for fastening or removably securing one object to another including, for example, standard push-button snaps, Velcro-type fasteners, adhesive substances, combinations thereof, and the like. It should also be noted that the adjustable fastener 18 may be configured in any array and/or number, so long as the adjustable fastener 18 functions in accordance with the present invention as described herein, specifically, to be adapted to releasably attach for adjusting length and positioning of the elongated garment 10.

Figure 3:
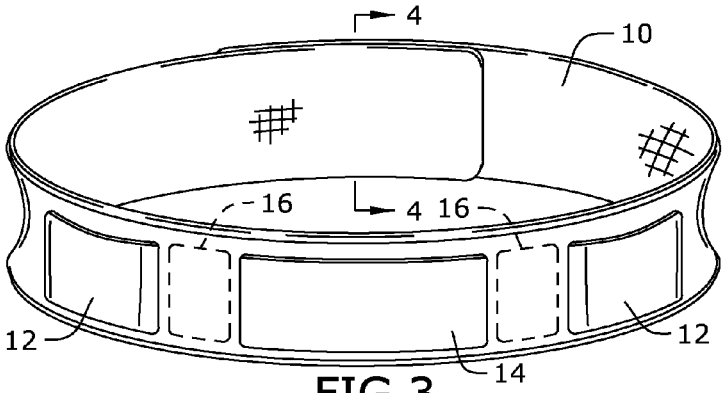
FIG. 3 is a front perspective view of an exemplary embodiment of the present invention.
Figure 4:
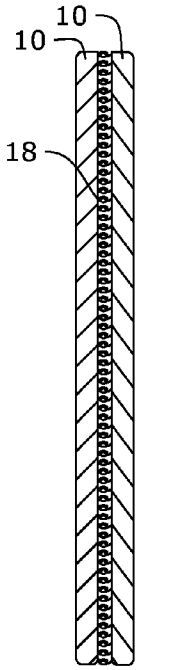
FIG. 4 is a section detail view of an exemplary embodiment of the present invention, taken along line 4-4 in FIG. 3.
Figure 5:
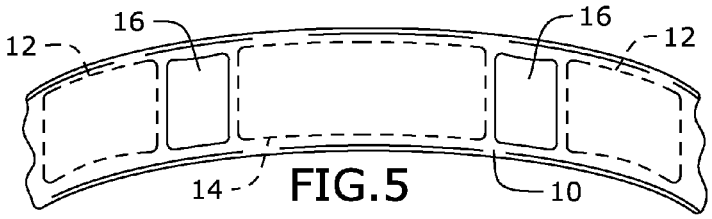
FIG. 5 is a rear detail perspective view of an exemplary embodiment of the present invention.
Figure 6:
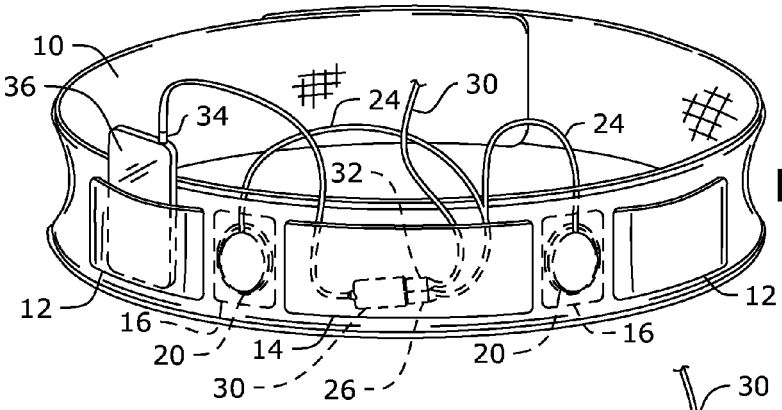
FIG. 6 is a front perspective view of an exemplary embodiment of the present invention.
Figure 7:
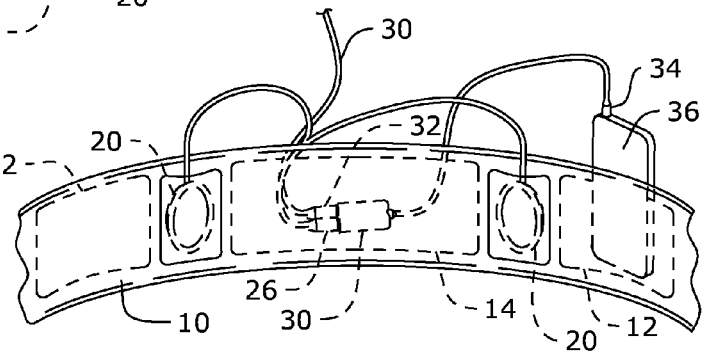
FIG. 7 is a rear detail perspective view of an exemplary embodiment of the present invention.

A plurality of pockets may be disposed along the length of the elongated garment 10 on the exterior and the interior surfaces. The plurality of pockets may include a plurality of side pockets 12 disposed along the exterior surface, a plurality of speaker pockets 16 disposed along the interior surface, and at least one intermediate pocket 14 disposed along the exterior surface, as illustrated in FIG. 3. Each speaker pocket 16 may be dimensioned and adapted to secure at least one speaker 20 therein. The intermediate pocket 14 may be dimensioned and adapted to secure a portion of the plurality of audio components. Each side pocket 12 may be dimensioned and adapted to secure at least a portion of the audio device 36.

The elongated garment 10 may be dimensioned and adapted to lift the abdominal area 40 of the wearer 38 and support the abdominal weight along the longitudinal axis of the elongated garment 10 and support the hips of the wearer 38. The elongated garment 10 may be dimensioned and adapted to wrap and conform to the abdominal area 40 and engage the hips so as to reduce pregnancy pelvic floor pressure and associated low back strain, thereby improving the posture of the wearer 38. The complementary portions of an adjustable velcro fastener 18 may be adjusted so that the plurality of pockets may be adjustably positioned relative to the abdominal area 40 or other portions of the wearer 38.

Figure 8:
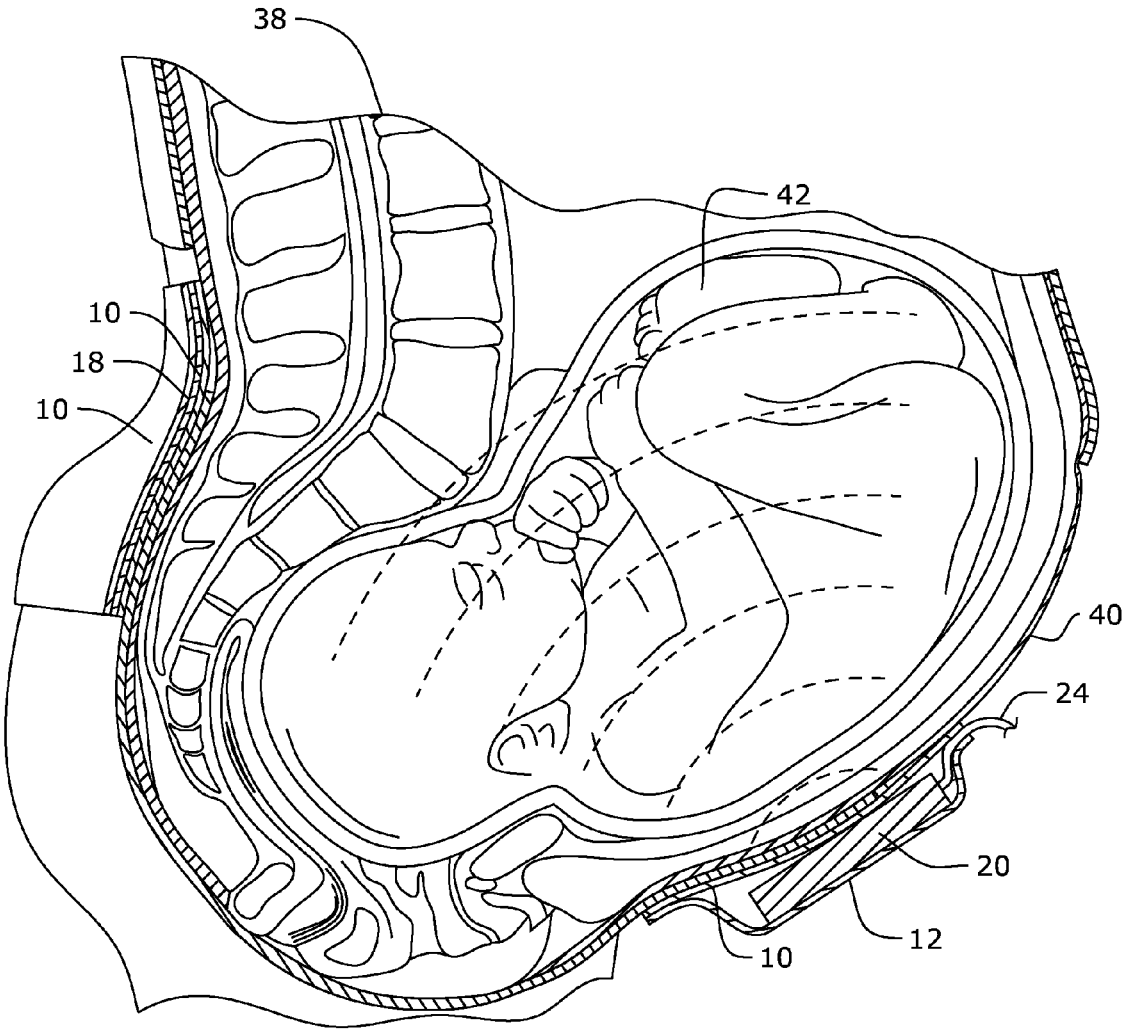
FIG. 8 is a section view of an exemplary embodiment of the present invention, taken along line 8-8 in FIG. 1.
Figure 9:
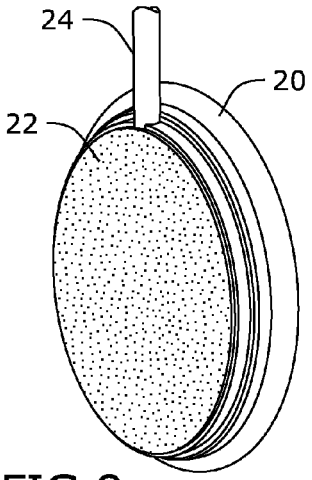
FIG. 9 is a rear perspective view of an exemplary embodiment of a speaker of the present invention.

In certain embodiments, the speaker pockets 16 and the speakers 20 therein may be positioned along predetermined portions of the abdominal area 40. The speakers 20 may be disposed so that the plurality of audio output is purposefully directed toward the predetermined portions of the abdominal area 40. Because research has shown that an unborn baby 42 may perceive and be attracted to the plurality of audio output, such purposeful direction along the predetermined portions may urge an unborn baby 42 of a pregnant wearer 40 into a head-down orientation, as illustrated in FIG. 8.

Figure 10:
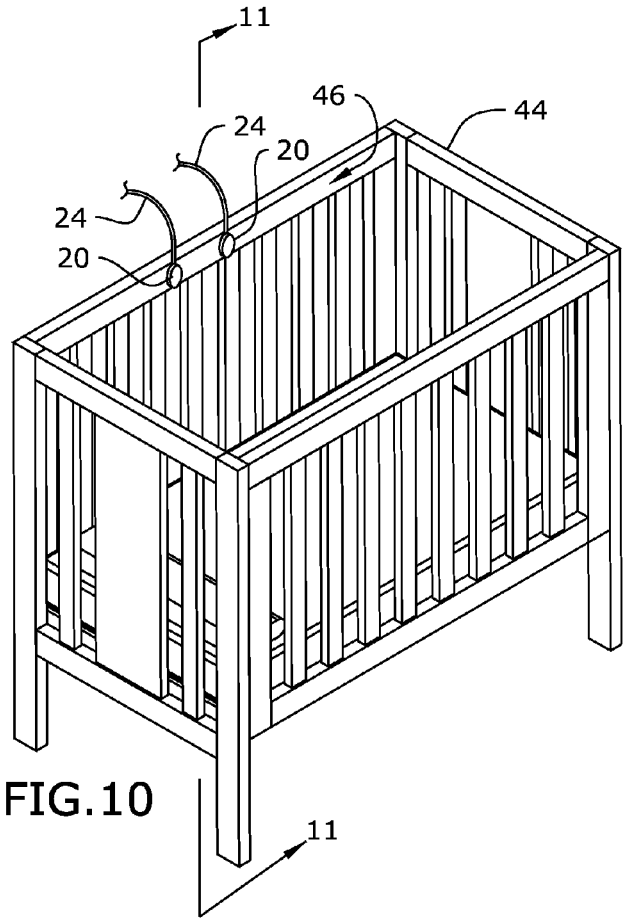
FIG. 10 is a perspective view of an exemplary embodiment of the present invention, shown in use.
Figure 11:
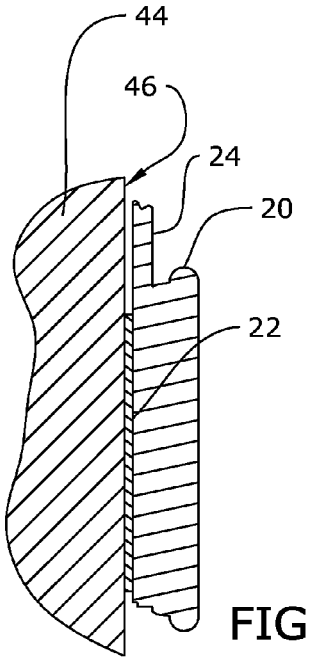
FIG. 11 is a section detail view of an exemplary embodiment of the speaker of the present invention, shown in use, taken along line 11-11 in FIG. 10.
Figure 12:
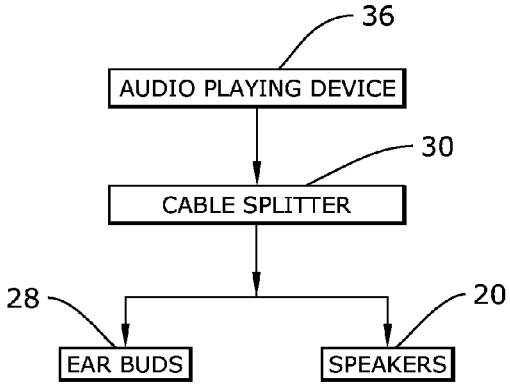
FIG. 12 is a schematic view of an exemplary embodiment of the present invention.

After birth, the same speakers 20 can produce the same plurality of audio output to the postpartum infant, for example, near the infant's crib, as illustrated in FIG. 10. During and after the pregnancy the mother and others can experience the same plurality of audio output as the unborn baby and infant by utilizing the headphones 28, supporting the user-child bond, calming infants for better breast feeding and bonding.

A method of using the present invention may include the following. The elongated garment 10 and the audio device 36 may be provided. A pregnant user may lift the abdominal area 40 so as to support the weight of the abdominal area 40 so as to support the hips of the wearer 38. Then the user may position at least one speaker 20 along the abdominal area 40 so that the plurality of safe-decibel audio output is directed toward the unborn baby 42 at a safe-decibel volume, as illustrated in FIG. 8. For example, each speaker 20 may be positioned so as to project the plurality of audio output upwardly from near the wearer's cervix and toward the unborn baby 42. Once the infant is born, at least one speaker 20 may be removably fixed to the infant's crib or stroller so as to project the same plurality of audio output toward the infant.

It should be understood, of course, that the foregoing relates to exemplary embodiments of the invention and that modifications may be made without departing from the spirit and scope of the invention as set forth in the following claims.

What is claimed is:

1. A method of urging a head of an unborn fetus in a downward orientation comprising:

providing a support wrap comprising:

an elongated material having a first end and a second end; and at least one speaker secured to the elongated material;

wrapping the support wrap around a pregnant human, wherein the support wrap engages the pregnant human's hips so as to reduce pregnancy pelvic floor pressure; and positioning the speaker only along a lower abdominal area below a womb of the pregnant human so as to project an audio output upwardly from near the pregnant human's cervix and toward the unborn fetus, wherein the audio output urges the head of the unborn fetus in the downward orientation.

2. A method of using an audio support wrap comprising:

providing a support wrap comprising:

an elongated material having an exterior surface and an interior surface, both surfaces extending from a first end to an opposing second end, wherein the elongated material is dimensioned so as to circumscribe an abdominal area and hips of a pregnant human wearer;

a plurality of pockets formed along at least one of the exterior surface and the interior surface;

at least one speaker disposed within one of the plurality of pockets, wherein the at least one speaker comprises an adhesive backing; and a connector;

wrapping the support wrap around a pregnant human and connecting the first end to the second end via the connector;

positioning the speaker only along a lower abdominal area to project an audio output toward the unborn fetus; and removing the speaker from the pocket and adhering the at least one speaker to a structure via the adhesive backing, wherein the structure is at least one of a stroller and a crib.

* * * * *